US010434817B2

(12) United States Patent
Chiao

(10) Patent No.: US 10,434,817 B2
(45) Date of Patent: Oct. 8, 2019

(54) HIGH-FUNCTION HEAT TRANSFER RELEASES

(71) Applicant: Avery Dennison Retail Information Services, LLC, Westborough, MA (US)

(72) Inventor: Yi-Hung Chiao, Indian Land, SC (US)

(73) Assignee: AVERY DENNISON RETAIL INFORMATION SERVICES, LLC, Mentor, OH (US)

( * ) Notice: Subject to any disclaimer, the term of this patent is extended or adjusted under 35 U.S.C. 154(b) by 0 days.

(21) Appl. No.: 15/353,170

(22) Filed: Nov. 16, 2016

(65) Prior Publication Data

US 2018/0134069 A1 May 17, 2018

(51) Int. Cl.
*B41M 3/12* (2006.01)
*B44C 1/17* (2006.01)

(52) U.S. Cl.
CPC ..... *B44C 1/172* (2013.01); *B44C 1/1716* (2013.01); *B41M 3/12* (2013.01)

(58) Field of Classification Search
CPC ..... B44C 1/172; B44C 1/1716; B44C 1/171; B41M 3/12; G09F 3/02; G09F 3/04; G09F 2003/0211; G09F 2003/0226; G09F 2003/025
USPC ..... 428/32.75, 32.77–32.79, 32.81, 202
See application file for complete search history.

(56) References Cited

U.S. PATENT DOCUMENTS

| | | | |
|---|---|---|---|
| 5,284,688 | A | 2/1994 | Hiatt |
| 6,096,408 | A | 8/2000 | Laprade et al. |
| 2005/0145325 | A1 | 7/2005 | Kronzer |
| 2006/0019043 | A1 | 1/2006 | Kronzer |

FOREIGN PATENT DOCUMENTS

| | | |
|---|---|---|
| EP | 1293355 | 3/2003 |
| EP | 2902213 | 8/2015 |

OTHER PUBLICATIONS

International Search Report and Written Opinion dated Jul. 18, 2017 prepared for PCT/US2016/062254.
International Search Report and Written Opinion of ISA/EPO dated Jul. 18, 2017 prepared for PCT/US2016/062254.

*Primary Examiner* — Bruce H Hess
(74) *Attorney, Agent, or Firm* — Avery Dennison Retail Information Services, LLC

(57) ABSTRACT

A heat transfer label is disclosed. The heat transfer label comprises a special heat stable release which strongly adheres to the carrier, offers a highly ink and adhesive wettable surface, stays intact under heat transfer bonding conditions, releases easily, leaves no contamination on the transfer or fabric, and enables durable replication of the release surface finish onto the resultant transfers.

18 Claims, 6 Drawing Sheets

HIGH-FUNCTION HEAT TRANSFER RELEASES

BACKGROUND

The present invention relates to a high-function heat stable release which strongly adheres to the carrier, offers a highly ink and adhesive wettable surface, stays intact under heat transfer bonding conditions, releases easily, leaves no contamination on the transfer or fabric, and enables durable replication of the release surface finish onto the resultant transfers. Accordingly, the present specification makes specific reference thereto. However, it is to be appreciated that aspects of the present inventive subject matter are also equally amenable to other like applications.

Printed heat transfer labels are well-known and commonly used to transfer a graphic, such as text or a graphic design, onto an item, such as apparel or merchandise. A heat transfer label is usually pre-printed with a graphic, and then the graphic is transferred from the label to the item using a heated pad or iron or the like. Printing techniques such as gravure printing, offset printing, flexographic printing, screen printing and digital printing all can be used to create a heat transfer label. Typically, the graphic is formed on a web or substrate onto which a release layer is applied. The ink graphic is applied to the release layer, followed by an adhesive. Thus, the adhesive is applied to the top surface of the graphic. When a user then applies the graphic to the item, the label is turned adhesive-side down onto the item and heat is applied to the back of the label substrate to transfer the graphic to the item from the release layer of the label substrate.

Many release materials used in heat transfers, however, lack the thermal stability or heat resistance under the temperature and pressure conditions during heat transfer application to stay intact throughout heat bonding and carrier peel. Such improper release layer often leads to an undesirable surface contamination of the heat transfer decoration. Thus, the release contamination will have the negative effects of covering the ink design, masking the fabric area in contact and various visual appearance changes by moisture exposure or washing. Further, current heat transfer releases are typically wax based which leaves a wax residue on the surface which negatively affects the appearance of heat transferred labels. Furthermore, current non-wax based releases resolve the wax residue issue, but have poor ink coverage or wetting issues and loose ink anchorage problems, such that there is high printing defect count and ink rub-off from the release surface during the printing operation.

The present invention discloses a special heat stable release which strongly adheres to the carrier, offers a highly ink and adhesive wettable surface, stays intact under heat transfer bonding conditions, releases easily, leaves no contamination on the transfer or fabric, and enables durable replication of the release surface finish onto the resultant transfers.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a high-function release system comprising a heat stable, film forming organic composition which constitutes the matrix or body of the release. The heat stable, film forming organic composition is a thermoset or chemically crosslinked composition. Initially, the organic composition is in liquid form to allow various industrial coating and printing operations for flood or pattern application to the carrier surface and to form a dense layer over the carrier surface. The release system also includes a surface active chemistry component which forms a structural linkage with the release matrix and has a uniform distribution over the surface or near-surface region of the release matrix or body. Further, the release system includes a dispersion of fine, heat stable solid phase(s) components in the release matrix and its surface. A combination of the above components when formed into an integrated structure enables the release to perform very successfully across a broad range of heat transfer labeling or decorating applications, and to introduce new functions and unique effects.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
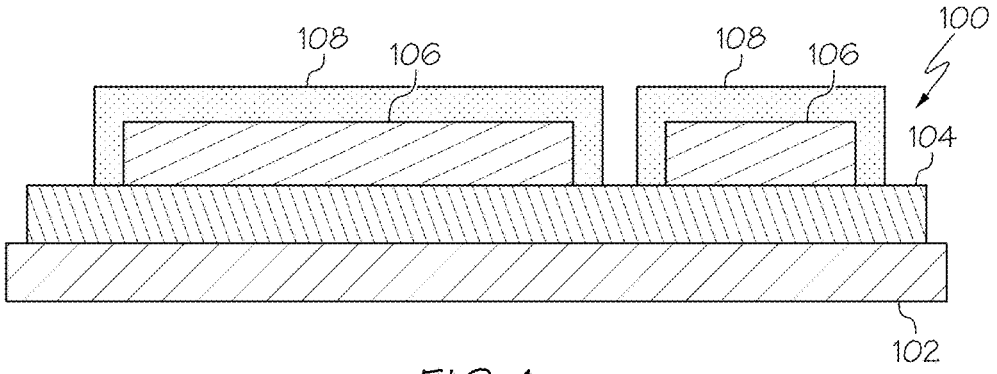
FIG. 1 illustrates a schematic cross-sectional view of a heat transfer label in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Figure 2:
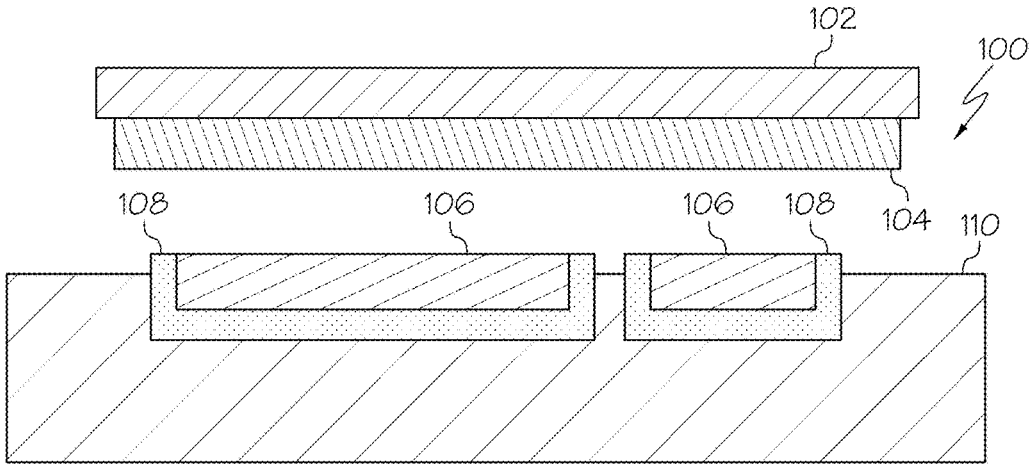
FIG. 2 illustrates a schematic cross-sectional view of a heat transfer label cleanly transferred to a heat transfer item.
Figure 3:
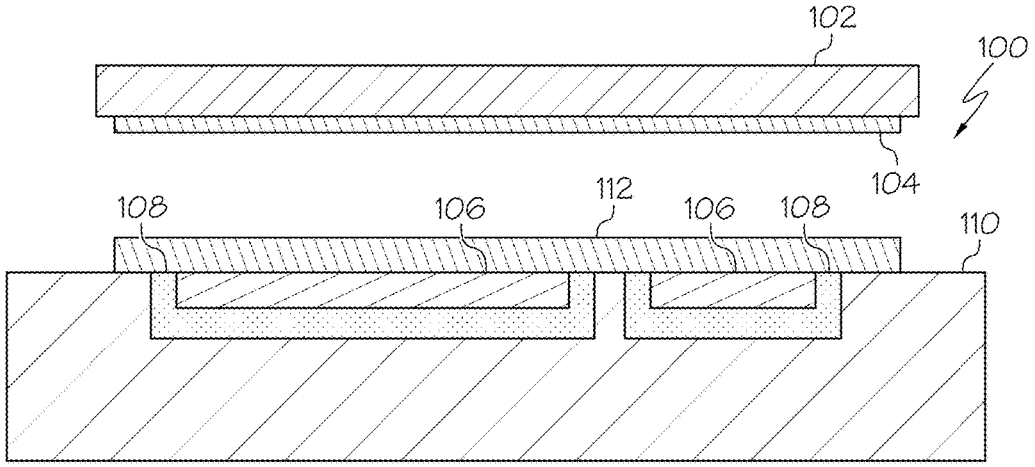
FIG. 3 illustrates a schematic cross-sectional view of a heat transfer label with release contamination to the label and item surfaces in accordance with the disclosed architecture.

As shown in FIGS. 1-3, a heat transfer label (HTL) 100 for application to an item (especially textile fabric, wearable article, or garment) typically includes a carrier 102 (plastic film or paper), a release layer 104 on or overlying the carrier surface, a single color or multi-color ink design layer(s) 106, and an adhesive layer 108 in alignment with the ink design layer 106.

However, although some layers or components of the HTL 100 are described as "overlying" or being "on" other layers or components, it will be appreciated that the HTL 100 may be inverted, such that different layers or components may be said to "overlie" or be "on" others. Accordingly, such terminology is provided merely for convenience of explanation and not limitation in any manner.

The HTL 100 can be used to decorate textiles or other receptor materials by placing the HTL design face down over the receptor item 110 (i.e., heat transfer item) and applying sufficient heat and pressure to adhere the ink design 106 and adhesive 108 onto the item surface. The carrier 102 is then peeled away to complete the transfer, as shown in FIG. 2.

Many release materials used in heat transfers, however, lack the thermal stability or heat resistance under the temperature and pressure conditions during heat transfer application to stay intact throughout heat bonding and carrier peel. Such improper release layers often leads to undesirable surface contamination 112 of the heat transfer decoration, as shown in FIG. 3. The release contamination will have the negative effects of covering the ink design, masking the fabric area in contact, and various visual appearance changes by moisture exposure or washing.

Figure 4:
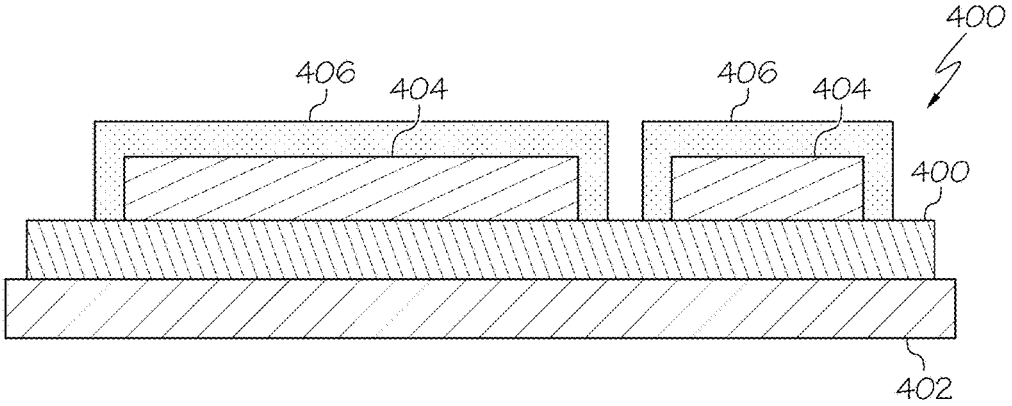
FIG. 4 illustrates a schematic cross-sectional view of the heat transfer label construction in accordance with the present invention.

As disclosed in FIG. 4, the present invention discloses a special heat stable release 400 which strongly adheres to the carrier, offers a highly ink 404 and adhesive 406 wettable surface, stays intact under heat transfer bonding conditions, releases easily, leaves no contamination on the transfer or fabric, and enables durable replication of the release surface finish (gloss, semi-gloss, matte, or combined gloss and matte) onto the resultant transfers.

The carrier 402 used in the high function release system can be plastic sheets, films, or paper stocks. Preferably, clear or translucent plastic films, such as (PET) polyethylene terephthalate or polycarbonate (PC) of about 2 mils to 5 mils in thickness, with smooth, non-contaminated surfaces for release layer application are utilized. The carrier 402 also prefers to have low heat shrinkage or expansion to allow printing registration.

The high-function release system comprises the below critical three components: (1) A heat stable, film forming organic composition which constitutes the matrix or body of the release. It is a thermoset or chemically crosslinked composition. Initially, the organic composition is in liquid form to allow various industrial coating and printing operations for flood or pattern application to the carrier surface and to form a dense layer over the carrier surface.

(2) A surface active chemistry component which forms structural linkage with the release matrix and has a uniform distribution over the surface or near-surface region of the release matrix or body. (3) And, a dispersion of fine, heat stable solid phase(s) components in the release matrix and its surface. A combination of (1) and (2), or the above (3) components into an integrated structure enables the release to perform very successfully across a broad range of heat transfer labeling or decorating applications, and to introduce new functions and unique effects.

The release chemistry in (1) involves the below key components:

Polymer, pre-polymer, oligomer or organic resin with chemically reactive side, end or pendant functional groups, such as —OH, —COOH, -epoxide, -silanol etc.

Diluent, liquid medium, or solvent for uniformly dispersing all the other chemical components in the release formulation.

Catalyst, preferably organo tin free, such as Zn or Bi based to speed up the reaction rate of the above cross-linking.

Cross-linker, or hardener, such as isocyanate, aziridine, carbodimide, polyamine, etc., to react with the reactive groups in the organic resin. In one embodiment, the film forming organic composition is a thermoplastic resin with glass transition temperature (Tg) above about 40° C. before cross-linking, and after cross-linking reaction is having heat stability or melting point above 160° C.

In one embodiment, the organic matrix composition is preferably a polyacrylate or polyester based resin with Tg above 40° C., and with —OH number above 80 mg KOH/g resin, and optionally additional —COOH, -silanol, -epoxide etc. contents. The corresponding cross-linker is preferably N containing as listed above, to create a highly heat stable release matrix with measurable N content on the surface by XPS or related analytical tools.

Additives such as deformer, leveling agent, anti-static agent, hardener blocking agent, pot-life extender, retarder, solvent drying agent etc. can also be included in an as needed basis.

The release chemistry in (2) involves the below key components:

Multi-segmented or branched macromer, pre-polymer or polymer with both matrix-compatible and matrix-incompatible sections. The matrix-compatible sections provide strong interaction or anchorage to the heat stable matrix, whereas the matrix-incompatible sections provide effective surface modification capacity. These surface modifiers, preferably low or medium MW surface active chemicals, are key to control the quality and physical/chemical properties of the liquid release formulation and the resultant solid release surface. The design of this chemical component enables good control of the release surface to enhance heat transfer label quality and its heat transfer performance. Examples include polyacrylate with ether (EO and/or PO) side branches, acrylate with —OH reactive group and silicone side branches, linear hydrocarbons or olefins with reactive isocyanate end group, etc. The listed surface active components when distributed on the physically and chemically linked structure of (1) and (2) after solvent drying and cross-link will exhibit measurable O content on the surface by XPS or related analytical tools. Presence of component (2) in the release also enables the surface energy as measured by dyne ink or pen to reach 40 dyne/cm or higher level. Additives based on silicone typically will decrease the surface energy and cause poor wetting or poor printability. Component (2) utilized in the present invention is found to be effective for maintaining high surface energy while allowing for the use of certain silicone for surface leveling, defoaming, and anti-blocking functions.

The release chemistry in (3) involves the below key components: a heat stable, solid state particulate matter of the inorganic (such as silica, or mineral filler) or organic (such as high melting point or thermoset polymer powder) types. Particle size is preferably about 1 μm to 50 μm which allows easy dispersion and uniform distribution over the release surface. Organic type solid phase is preferred based on its ease of handling, low moisture sensitivity, high stability against settling, and excellent linkage to components (1) and (2). Additives, such as dispersing enhancers, foam-controlling agents, anti-static agents, viscosity modifiers, etc. may also be included in formulating component (3) into the system. Organic type solid phase preferably has heat stability above 160° C. to suit for the disclosed heat transfer release application.

The present release chemistry can be prepared as 1-pack or 2-pack systems. For 1-pack system, the pot life is about 2-8 hours at room temperature, and a hardener blocking agent can be used for long term storage, and later hardened by heat cure after application. For the 2-pack system, Part A typically includes the reactive resin, catalyst, and surface modifier with any needed additives, and Part B typically is the hardener with any needed medium or viscosity adjusters. The preparation of Part A usually needs a high or medium shear mixer, such as a Cowles type, to ensure complete dispersion and homogenization of all the chemical components. Care should be taken to avoid using low purity components or exposure to contamination, moisture, dust, etc. Part B, if it is flowable, can be packed in a closed container, if not flowable, can use a proper, non-reactive solvent to dilute to the desired viscosity level. Before application, Part A is to mix with Part B at a specified amount ratio based on the related contents of the reactive components, with any needed solvent or additional additives.

Methods of applying the high-function release system on a carrier surface include sheet-fed printing or coating and web printing or coating. The former can be flat-bed screen printing, the latter can be reverse gravure coating. After wet printing or coating, the sheet or web is subject to a heating/drying process to remove the solvent, and initiate the cross-linking reaction to form the release coated carrier sheets or web. Additional aging or annealing may also be used to further improve dimensional stability of the carrier. The release coated sheets or web can be further slit down or precision cut to fit a special printer format for the subsequent ink and adhesive application.

Heat transfer labels can be prepared by analog or digital printing of the one-color or multi-color design onto the release surface in sheet-fed or web format. Then apply the adhesive in communication with the ink design by analog printing or a powder scattering process. The printed material is further slit or cut into a narrower web or single labels and packaged for storage or transportation.

Transfer of the printed design on the HTL onto the receptor item surface is done by a heat bonding press, with heated platen, pneumatic pressure control, sensor or operator activated operation. Typical bond settings are 120-160° C., 0.2-2.0b, 1-15 s to suit for various fabric types and bonder configurations. Removal of the carrier from the heat transfer on the receptor item after bonding can be done immediately or while still hot, semi-hot or when cold.

Figure 5A:
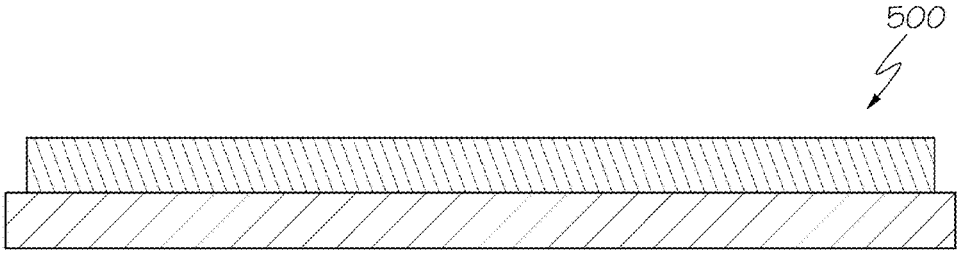
FIG. 5A-FIG. 5E illustrate schematic cross-sectional views of the various high-function release surfaces and constructions in accordance with the present invention.
Figure 5B:
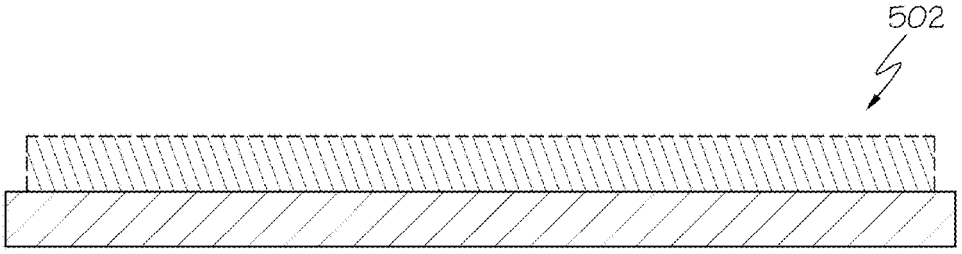
Figure 5C:
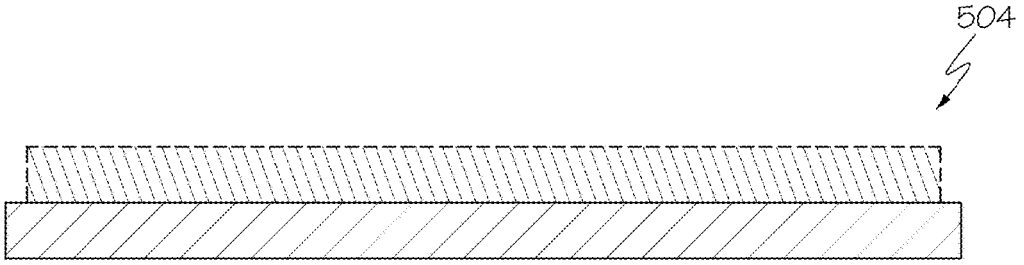
Figure 5D:
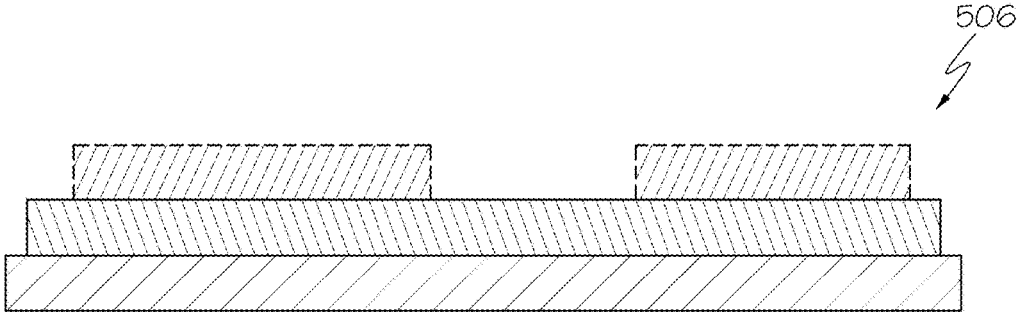
Figure 5E:
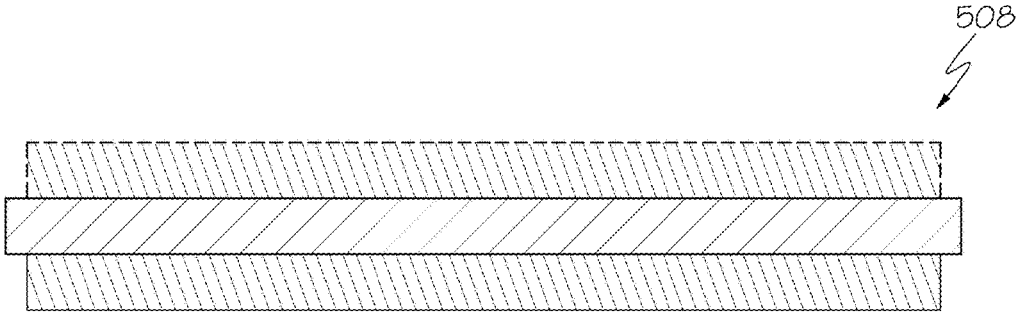

As shown in FIGS. 5A-E, one special feature of the present invention is enabling surface texture of the release surface to be transferred to the final heat transfer design and has high resistance against fading due to washing, abrasion etc., as compared to conventional releases. Gloss finish 500 on the heat transfer can be done with smooth surface release of the present invention, as shown in FIG. 5A. Semi-gloss finish 502 can be done with lightly textured release of the present invention, as shown in FIG. 5B. Matte finish 504 can be done with highly texture release of the present invention, as shown in FIG. 5C. Surface finish 506 with both matte and gloss together can also be accomplished by a patterned release structure of the present invention, as shown in FIG. 5D. In addition to the front or job side release, the opposite surface of the carrier can also be covered by the present release structure to offer double-side release, anti-backing, slip or friction controls 508, as shown in FIG. 5E.

The present invention may more clearly be understood by reference to the following examples, it being understood that such examples are illustrative and not to be considered as limiting of the invention.

Example 1

Gloss Release composition and application to carrier surface by screen printing. One example of the gloss release compositions of the present invention is:

| Gloss Release | (g) |
|---|---|
| CAStat 308 | 0.54 |
| Joncryl 587 | 120.12 |
| BLO | 170.23 |
| Byk 3560 | 5.01 |
| XK-635 | 0.52 |
| Tego Protect 5001 | 1.31 |
| STI-95 | 3.05 |
| XR-2500 | 0.55 |
| Tolonate HDT-90 | 46 |

Here, CAStat 308 is an anti-static agent (by Lubrizol®), Joncryl-587 is polyacrylate with —OH and —COOH function groups (by BASF®), BLO is butyrolactone solvent (by Ashland®), BYK™ 3560 is surface modifier agent with polyether function (by Byk®), XK-635 is cross-linking catalyst (by King Industries®), Tego® Protect 5001 is another reactive surface modifier agent (by Evonik®), STI-95 is hydrocarbon with isocyanate function (by Lanxess®), XR-2500 is aziridine hardener (by Avery Dennison®), Tolonate™ HDT-90 is a polyisocyanate hardener (by Vencorex®).

The above components were added one after the other into a clean container, homogenized by a Cowles mixer under medium to high shear at room temperature to obtain the release formula for screen printing application onto carrier.

The carrier film used was 100 nm thick PET film in sheet form of 550 mm×700 mm. Print screen was #460 mesh flood screen, mounted on an Avery Dennison cylinder screen print press for auto-feeding release printing. The printed sheets then drying through the HT-003 conveyor tunnel by both thermal and IR heating at set temperature of 130° C. for about 40 s. The sheets then went through a short cooling section before being stacked at the end. The release coated carrier sheets can further be heat aged at a temperature from about 30° C. to about 120° C. as an option to further stabilize the carrier. The obtained release film has the layer structure as illustrated in FIG. 5A.

Example 2

Matte Release Composition and Application to Carrier Surface by Screen Printing.

| Matte Release | (g) |
|---|---|
| Ceraflour 920 | 50.09 |
| CAStat 308 | 1.06 |
| Joncryl 550 | 240.58 |
| BLO | 143.00 |
| Byk 3560 | 6.08 |
| K-Kat XK-635 | 1.56 |
| Tego Protect 5001 | 1.54 |
| STI-95 | 6.00 |
| Tolonate HDT-90 | 56.00 |

Here Ceraflour 920 is an organic powder based matting agent (by Byk), Joncryl™-550 is polyacrylate with —OH function group. Printing was conducted the same way as in Example 1. The obtained release film has the layer structure illustrated as FIG. 5C.

Example 3

Gloss+Matte Combined Release for unique "water mark" effect on heat transfer design. This special Gloss+Matte combined release was made by a 2-step release printing process. First, flood print the Gloss Release on PET as Example 1. Second, design a screen with a patterned structure for the desired "water mark", then print the matte release through the pattern screen (460 mesh or coarser) over the gloss release sheets on the cylinder screen print press. The obtained release film has the layer structure as illustrated in FIG. 5D.

Figure 6:
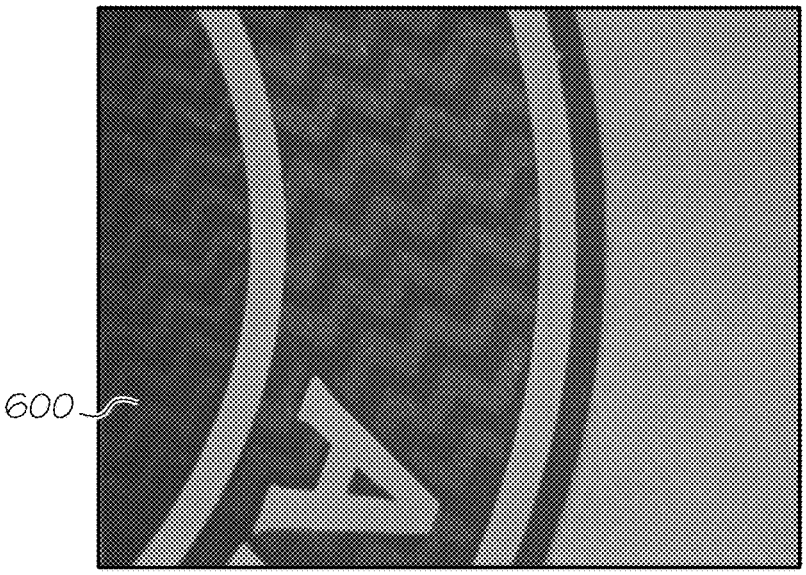
FIG. 6 illustrates a perspective view of a heat transfer decoration with combined gloss and matte finish effect in accordance with the present invention.

The Gloss+Matte release printed sheets were then printed on a flat-bed screen print press using a water based red ink (AQ red), a water based white backer (AQ white), and water based adhesive (AG adhesive). Dryer settings were 120° C. with IR on for the inks, and 85° C. with IR off for the adhesive, the heating time in the HT004 tunnel conveyor was about 45 s. The printed design arts obtained on the 550 mm×700 mm sheets were cut into proper label size, and was then heat bonded to a white polyester fabric, under conditions of 140° C., 10 s, 1.5b, and tested for ease of peel under Hot, Tepid and Cold peel conditions. The printed design prepared on the above Gloss+Matte release carrier when being transferred to a fabric surface, is able to create the special "water mark" pattern across the color design, 600 as in FIG. 6, where a single color (red) is having both gloss and the wave shape patterned matte finishes. Such texture replication on the label was wash durable and the "water mark" effect stayed after repeated laundry.

The below table shows the transfer peel test under hot, tepid and cold conditions of this label along with the visibility of the obtained "water mark" effect after repeated hot water (60° C.) washings.

| Gloss + Matte HTL | ease of peel | "water mark" effect | effect after 5× wash |
|---|---|---|---|
| Hot Peel | EASY | Present | Present |
| Tepid Peel | EASY | Present | Present |
| Cold Peel | EASY | Present | Present |

Example 4

Semi-Gloss Release Composition and Application to Carrier Surface by Gravure Coating.

| SG.IR | lbs |
|---|---|
| Ceraflour 920 | 22.0 |
| CAStat 308 | 1.0 |
| Joncryl 550 | 240.0 |
| MEK/Tol | 340.0 |
| Byk 3560 | 6.0 |
| K-Kat XK-635 | 1.5 |
| Tego Protect 5001 | 1.5 |
| STI-95 | 6.0 |
| Tolonate HDT-90 | 53.3 |

Here, the solvent used is a 1:1 volume ratio of methyl ethyl ketone with toluene, the release composition was compounded by a Cowles type high shear mixer without the hardener. The hardener was blended in with optionally additional solvent before coating. The coating was run on the a gravure coating line using a web of 20" or 40" width PET of 100 um thickness (The coating mode was reverse-gravure with chrome faced cylinder of designed cell structure (85 lpi, mechanically engraved PQCH cell pattern, cell volume 33.30 bcm). The coating was run at a line speed of 150 ft/min, with the 3-zone heating section set at an average temperature of 200 F. The web after heating, about 10 s, was air cooled and rewound into roll form.

Figure 7:
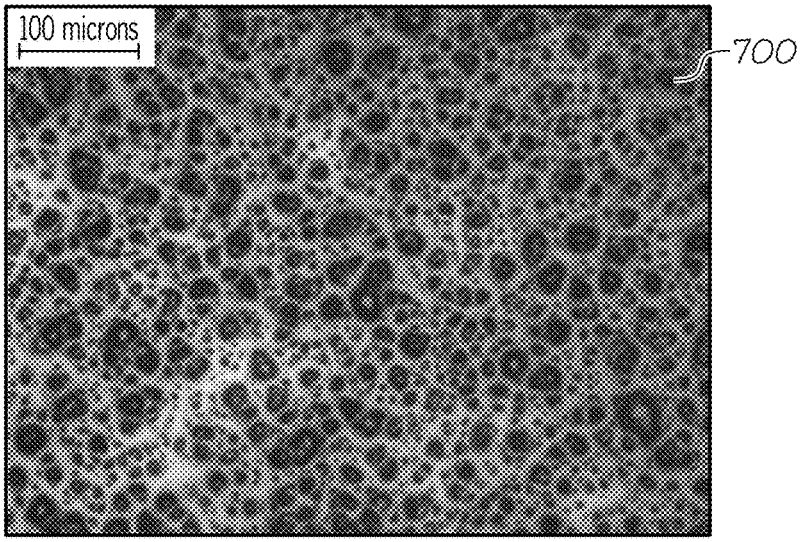
FIG. 7 illustrates a perspective view of a structured release surface of the heat transfer label in accordance with the present invention.

The coated sheets were measured to have a dry coat weight of 3.0 gsm (g/m^2) with uniform coverage on the PET surface, and no blockage due to rewinding. The coated roll was then silted into proper size, and placed in a Blue-M oven for further heat cure at 90° C. for about 72 hours. The structured release surface 700 as viewed under SEM is shown in FIG. 7. The surface as shown is dense and uniformly dispersed with heat stable solid phase particles securely linked to the matrix structure. The chemical composition of the obtained release surface was determined by XPS (x-ray photoelectron spectroscopy) as shown in the table below.

| Sample ID | C (atomic %) | N (atomic %) | O (atomic %) | Si (atomic %) |
|---|---|---|---|---|
| SG.IR | 78.5 | 3 | 15.8 | 2.7 |
| SG.IR, repeat 1 | 76.7 | 3.9 | 16.5 | 2.9 |
| SG.IR, repeat 2 | 76.2 | 4.2 | 16.7 | 2.9 |
| Average | 77.1 ± 1.2 | 3.7 ± 0.6 | 16.3 ± 0.5 | 2.8 ± 0.1 |

Heat transfer labels with designed artwork were made on Atma screen printing line using a water based screen printing inks (Adf black, ADM, Adf clear, etc. from Avery Dennison) and a water based screen print adhesives (AG or QL from Avery Dennison) or scatter applied powder adhesives (e.g. A23 from Avery Dennison). Exemplary screens suitable for the printing are 230 mesh for the inks, and 123 mesh for the adhesives. Each layer printed on the SG.IR release surface was heat and IR dried through HT-004 tunnel oven at temperatures of around 95° C.-115° C., typical heating time in tunnel oven is 40-45 s.

Print ink wet-out on the release surface was found to be closely related to the surface energy of the release film. Surface energy as measured by dyne pen for the current release vs. a comparison KP44LMTCGR4812 (by Hanse®) is shown in the below table. Ink wet-out comparison was made by printing a single layer of a water based ink, e.g. Avery Dennison's ADF black screen ink, on the release film surface and measure the defect counts by an image analyzer, or an optical microscope under uniform back-lighting, FIG. 8.

| Release Sample | Release surface energy | Print defect counts |
|---|---|---|
| KP44LMTCGR4812 release | 32 dyne/cm | High |
| SG.IR release | 42 dyne/cm | Low |

Figure 8A:
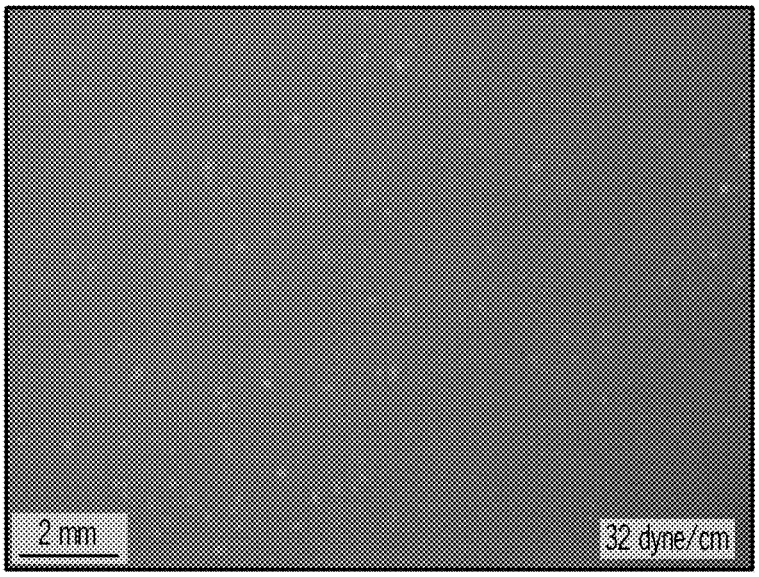
FIG. 8A and FIG. 8B illustrate improved print quality on a release surface of the present invention.
Figure 8B:
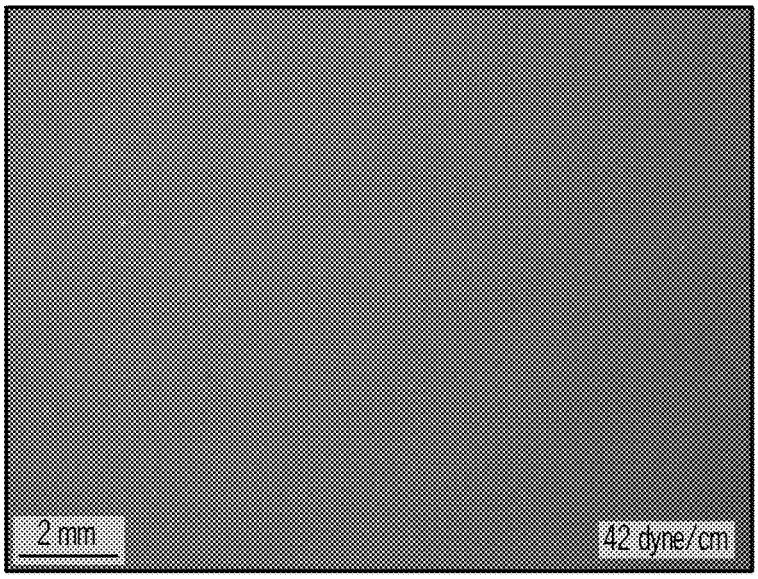

FIG. 8 illustrates micrographs of ink coverage over release surfaces with different surface energies, 32 dyne/cm vs 42 dyne/cm. (Left) For KP44LMTCGR4812 release (32 dyne/cm), the ink coverage was not smooth with high print defect count. (Right) For SG.IR release (42 dyne/cm), the coverage was smooth with very low print defect count.

For heat transfer peel force measurement, a label construction with the below layers of a single color and solid coverage of 1"×6" in shape was used—(1) carrier, i.e. SG.IR coated PET film, (2) ink design, (3) registered adhesive.

The screen printed test design was cut into strips and heat bonded to heavy weight cotton fabric (Interlock cotton) by a heat transfer bonder at 320 F, 8 s, 1.5b. The obtained heat laminates were allowed to cool to room temperature then tested on the Instron tensile tester by the T-peel mode at a constant peel rate of 12"/min with a 50N load cell. The peel force was averaged over at least 8" extension range for each specimen, and was done on at least 3 specimens for each tested release film.

| Release Carrier | Ink Type | Adhesive Type | Instron Peel Force (N/inch) |
|---|---|---|---|
| SG.IR | Adf black | AG | 0.16 |
| SG.IR | Adf black | Powder | 0.11 |
| SG.IR | ADM | Powder | 0.13 |

As shown in the table, the present release performed well for heat transfer label printing as well as easy heat transfer with low peel forces.

Example 5

Release Suitable for Digital Print Heat Transfers.

For this type of digital, high-definition image transfer applications, the present release as illustrated in the above examples (e.g. SG.IR) was further primed with a thin layer of primer to successfully accept HP Indigo ElectroInks for making digital color design HTL. One example of compatible primer to use with the present release system is DigiPrime 5000 (by Michelman®).

Figure 9:
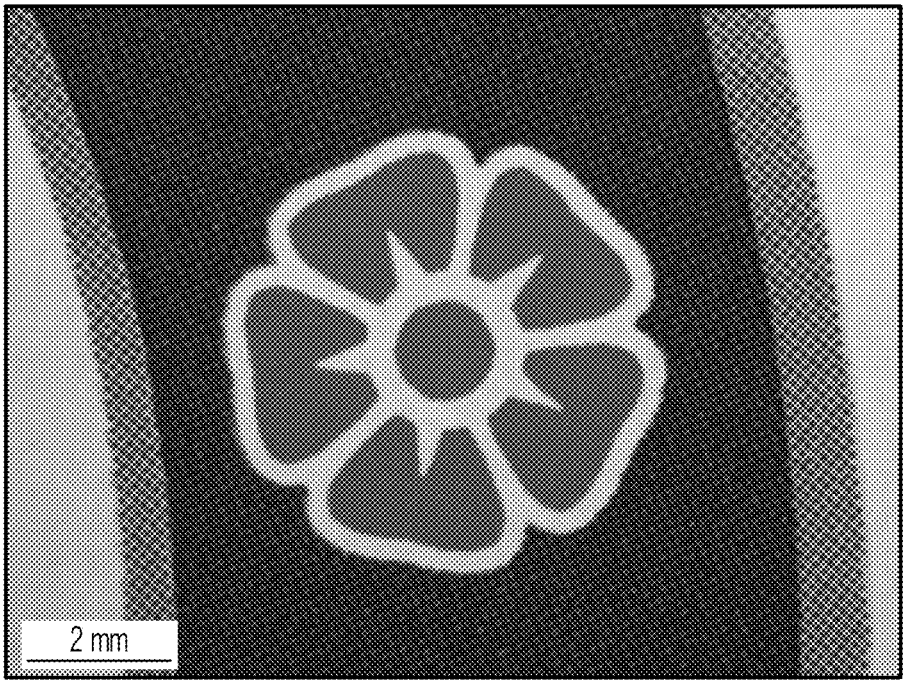
FIG. 9 illustrates a transfer on a polyester fabric surface with sharp pixel dots and a semi-gloss finish.

The primed release is then fed through a HP Indigo 5500 press for the color printing, followed by screen printing a white backing ink layer and the printed or scattered adhesive. The resultant digital print heat transfer label was applied to target substrates using the heat transfer methods described above. FIG. 9 shows the obtained transfer on a polyester fabric surface with sharp pixel dots and a semi-gloss finish replicated from the texture on the SG.IR release sheet surface. The surface finish was wash durable, not changed after laundering.

Example 6

Durability of Surface Texture Effect Created by Present Invention Versus Conventional Releases.

The release made according to the present invention was wash tested against a wax based release reference (Avery Dennison release 3.04.) The two types of releases were screen printed on 4 mil PET sheets, then pattern printed with water based black ink and adhesive. The printed design was then heat transferred to a polyester fabric under 140° C., 10 s, 1.5b setting and peeled away the carrier immediately after the bonder platen disengaged, i.e. hot peel.

The resultant transfer pieces were measured for gloss and color before wash, and re-measured after 1 cycle of 40° C. wash, then after 5 cycles of 40° C. wash, and finally after additional 5 wash cycles at 60° C. The below Table compares the gloss change of the current gloss release sample G-1 versus a wax based 3.04 release sample. The G-1 sample retained most of its initial gloss throughout the washing cycles, whereas the wax release sample had huge gloss change even after 1 cycle of wash. The same occurred with color change, the heat transfer made with G-1 release showed very little color change after washing, whereas the comparison had significant color change.

Gloss level change by wash (5×40° C.+5×60° C.):

| Test Samples | Initial gloss (60°) | Gloss after 1st wash | Gloss after 5th wash | Gloss after 10th wash |
|---|---|---|---|---|
| G-1 | 13.8 | 9.9 | 8.6 | 8 |
| 3.04 | 10.1 | 1.1 | 1.2 | 1.3 |

Color change by wash (5×40° C.+5×60° C.)

| Test Samples | Initial (L, a, b) | ΔE after 1st wash | ΔE after 5th wash | ΔE after 10th wash |
|---|---|---|---|---|
| G-1 | (25.53, 0.64, 1.89) | 0.4 | 0.34 | 0.67 |
| 3.04 | (25.77, 0.10, 0.05) | 3.46 | 2.84 | 3.01 |

Example 7

Carrier with release on each surface, as illustrated in FIG. 5E. For heat transfer label printing, the front surface is used for accepting the printing inks and adhesives, the opposite side can optionally be release covered to serve additional functions, such as slip control, anti-blocking, anti-curling etc. On a 4 mil thickness PET film roll of 40" width, the front surface semi-gloss release was applied on a gravure coater as Example 4. The dried film web was loaded on the coater for the second pass using the below Gloss Backing composition on the back side of the film.

| Gloss Backing | lbs |
|---|---|
| CAStat 308 | 0.2 |
| Joncryl 587 | 15 |
| MEK/Tol | 24 |
| Byk 3560 | 0.6 |
| K-Kat XK-635 | 0.15 |
| Tego Protect 5001 | 0.3 |
| Tolonate HDT-90 | 5.4 |

The double side coated carrier thus prepared has the semi-gloss release on the top surface of the carrier and a gloss release on the opposite surface for ease of handling and prevention of blockage throughout printing, stacking and cutting operations. The difference of the gloss and surface tension between the two release surfaces is shown below. The high surface tension of the front release enables easy wetting and printing of inks and adhesives, and the low surface tension and high gloss back release ensures blocking resistance.

| Ex. 7 Carrier | Finish | 60° Gloss | Surface Tension |
|---|---|---|---|
| Front Surface | Semi-gloss | 18.1 | 40 dyne/cm |
| Back Surface | Gloss | 80.1 | 30 dyne/cm |

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A heat transfer label for application to an item, comprising:

a carrier;

a release layer on the carrier surface;

an ink design layer;

an adhesive layer in registration with the ink design layer; and wherein the release layer comprises a heat stable film forming organic composition which comprises a thermoset or chemically crosslinked composition, a surface active chemistry component comprising a multi-segmented or branched macromere, pre-polymer or polymer with both matrix-compatible and matrix-incompatible sections, and a dispersion of fine, heat stable solid phase components.

2. The heat transfer label of claim 1, wherein the carrier comprises a plastic sheet, film, or paper stock.

3. The heat transfer label of claim 1, wherein the heat stable film forming organic composition constitutes a matrix or body of the release layer.

4. The heat transfer label of claim 1, wherein the ink design layer is a single color ink design layer.

5. The heat transfer label of claim 1, wherein, the release layer has a composition of 70-85 at % carbon, 1-10 at % nitrogen, 10-25 at % oxygen, and 0-10 at % silicon.

6. The heat transfer label of claim 1, wherein the release layer is applied to a front and a back of the carrier for double-sided release.

7. A heat transfer label for application to an item, comprising:

a plastic film carrier;

a release layer on the carrier surface;

a multi-color ink design layer; and an adhesive layer in registration with the ink design layer; and wherein the release layer comprises a heat stable film forming organic composition which comprises a thermoset or chemically crosslinked composition, a surface active chemistry component comprising a multi-segmented or branched macromere, pre-polymer or polymer with both matrix-compatible and matrix-incompatible sections, and a dispersion of fine, heat stable solid phase components.

8. The heat transfer label of claim 7, wherein the heat stable film forming organic composition constitutes a matrix or body of the release layer.

9. The heat transfer label of claim 7, wherein the surface active chemistry component forms a structural linkage with the release layer matrix and has a uniform distribution over the surface region of the release layer matrix.

10. The heat transfer label of claim 9, wherein the surface active chemistry component forms a structural linkage with the release layer matrix and has a uniform distribution over a surface region of the release layer matrix.

11. The heat transfer label of claim 10, wherein the dispersion of fine, heat stable solid phase components are distributed in the release layer matrix and its surface.

12. The heat transfer label of claim 11, wherein the release layer is applied to the carrier surface via sheet-fed printing or coating and web printing or coating.

13. The heat transfer label of claim 9, wherein the dispersion of fine, heat stable solid phase components are distributed in the release layer matrix and its surface.

14. The heat transfer label of claim 7, wherein the release layer is applied to the carrier surface via sheet-fed printing or coating and web printing or coating.

15. The heat transfer label of claim 7, wherein the release layer is applied to a front and a back of the carrier for double-sided release.

16. A heat transfer label for application to an item, comprising:

a plastic film carrier;

a release layer on the carrier surface;

a multi-color ink design layer;

an adhesive layer in communication with the ink design layer; and wherein the release layer comprises a heat stable film forming organic composition which constitutes a matrix or body of the release layer and comprises a thermoset or chemically crosslinked composition, a surface active chemistry component comprising a multi-segmented or branched macromere, pre-polymer or polymer with both matrix-compatible and matrix-incompatible sections, and a dispersion of fine, heat stable solid phase components which are distributed in the release layer matrix and its surface.

17. The heat transfer label of claim 16, wherein the surface active chemistry component forms a structural linkage with the release layer matrix and has a uniform distribution over the surface region of the release layer matrix.

18. A release functionalized carrier suitable for heat transfer applications comprising:

a heat stable film forming organic composition which comprises a thermoset or chemically crosslinked composition;

a surface active chemistry component comprising a multi-segmented or branched macromere, pre-polymer or polymer with both matrix-compatible and matrix-incompatible sections; and a dispersion of fine, heat stable solid phase components.

* * * * *